US005969361A

United States Patent [19]

Blavette et al.

[11] Patent Number: 5,969,361

[45] Date of Patent: Oct. 19, 1999

[54] TRANSPARENT POSITION-SENSITIVE PARTICLE DETECTOR

[75] Inventors: Didier Blavette, Saint Lucien; Alain Bostel, La Haye du Theil; Bernard Deconihout, Rouen, all of France

[73] Assignee: Centre National de la Recherche Scientifique, Paris, France

[21] Appl. No.: 08/983,436

[22] PCT Filed: Jul. 16, 1996

[86] PCT No.: PCT/FR96/01100

§ 371 Date: Feb. 11, 1998

§ 102(e) Date: Feb. 11, 1998

[87] PCT Pub. No.: WO97/04335

PCT Pub. Date: Feb. 6, 1997

[51] Int. Cl.[6] ..... H01J 43/00; H01J 43/04

[52] U.S. Cl. ..... 250/397; 313/103 R; 313/532

[58] Field of Search ..... 250/397; 313/103 R, 313/532, 530, 528

[56] References Cited

PUBLICATIONS

M.K. Miller, "Implementation of the optical atom probe", pp. 494–500, Surface Science 266 (1992).

A. Cerezo, T.J. Godfrey, and G.D.W. Smith, "Application of a position–sensitive detector to atom probe microanalysis", pp. 862–866, Rev. Sci. Instrum. 59(6), Jun. 1988.

D. Blavette, A. Bostel, J.M. Sarrau, B. Deconihout, A. Menand, "An atom probe for three–dimensional tomography", pp. 432–434, Nature vol. 363, Jun. 3, 1993.

D. Blavette, B. Deconihout, A. Bostel, J.M. Sarray, M. Bouet, A. Menand, "Review of Scientific Instruments", pp. 2911–2919, vol. 64, No. 10, Oct. 1993, American Institute of Physicis.

B. Deconihout, A. Bostel, P. Bas, S. Chambreland, L. Letellier, F. Danoix D. Blavette, "Investigation of some selected metallurgical probelms with the tomographic atom probe", pp. 145–154, Applied Surface Science 76/77 (1994).

B. Blavette and A. Menand, "New Developments in Atom Probe Techniques and Potential Applications to Materials Science", pp. 21–26, Materials Research Society, vol. XIX, No. 7, Jul. 1994.

B. Deconihout, A. Bostel, M. Bouet, J.M. Sarrau, P. Bas, D. Blavette, "Performance of the multiple events position sensitive detector used in the tomographic atom probe", pp. 428–437, Applied Surface Science 87/88 (1995).

A. Cerezo, T.J. Godfrey, J.M. Hyde, S.J. Sijbrandij, G.D.W. Smith, "Improvements in three–dimensional atom probe design", pp. 374–381, Applied Surface Science 76/77 (1994).

Tohru Kinugawa and Tatsuo Arikawa, "Position–sensitive time–of–flight mass spectrometer using a fast optical imaging technique", pp. 3599–3607, Rev. Sci. Instrum. 63 (7), Jul. 1992.

*Primary Examiner*—Edward P. Westin
*Assistant Examiner*—Nikita Wells
*Attorney, Agent, or Firm*—Burns, Doane, Swecker & Mathis LLP

[57] ABSTRACT

This detector comprises electron multiplication means (14) producing a cluster of electrons under the impact of each particle (2), a layer (6) that this cluster passes through, and which emits a light pulse by interaction with the layer, and transparent electron detection means (8) capable of determining the moment of impact of the particle and supplying information about the impact positions for each moment thus determined, so that these positions can be determined and correlated with the moments determined by the detection means.

10 Claims, 4 Drawing Sheets

TRANSPARENT POSITION-SENSITIVE PARTICLE DETECTOR

DESCRIPTION

1. Technical Field

This invention relates to a particle detector sensitive to the position.

"Particles" refers particularly to charged particles such as ions and electrons, and photons.

The invention is applicable particularly to atom probes and more particularly to any domain in which a correlation between space and time is to be found.

For example, the invention is thus applicable in particle Physics to Time of Flight Secondary Ion Microscopy, mass spectrometry and Time of Flight Charge Coupled Devices.

The invention can precisely identify particle impacts on a detector fitted with electron multiplication means (usually microchannel plates), in space and time.

These particles may reach the detector at very close instants, or simultaneously.

Therefore, the invention relates to a two-dimensional spatial detector with high spatial resolution and high time resolution.

2. State of Prior Art

Several spatial particle detectors that use Microchannel Plates are already known.

During the last twenty years, it has been necessary to develop this type of detector in a wide variety of domains, such as spatial imagery or elementary particle physics.

However, very few detectors are capable of localizing multiple impacts in both space and time.

The fields of application for which these detectors have been developed explain the limitations of typical spatial detectors to a large extent.

Thus, detectors developed for imagery give a very good spatial resolution but are incapable of precisely measuring impact instants.

In the elementary particles domain, a large number of systems have been developed capable of precisely measuring the instant of impact and the position of particles.

These systems, which have been developed for detection of rare events, are frequently incapable of resolving simultaneous events, or events very close in time.

Thus a distinction is made between two major families of spatial detectors.

The first family includes detectors sensitive to simultaneous events but with a mediocre time resolution.

For example, this is the case of CCD camera detectors.

These detectors have a good spatial resolution and are sensitive to multiple events.

However, the information "read" time for a CCD camera is long (several milliseconds) and thus determines the "dead time" in the time of flight measurement system associated with the camera.

When events are separated by a time less than his dead time (which is always the case in an atom robe), it is impossible to unambiguously assign a time of flight to a displayed impact.

In this respect, refer to document (1) which, like the other documents mentioned below, is mentioned at the end of this description.

Therefore, this limitation prevents its use for this application.

The second family includes "fast" detectors.

These detectors are capable of discriminating impacts very close together in time, separated only by a few tens to a few hundreds of nanoseconds.

The best known among them are the Resistive Anode Encoder and the Wedge And Strip Anode.

Refer to document (2) for further information about this subject.

The principle of these detectors is based on a spatial or time division of the charge generated by the impact at the exit from the microchannel plates.

These detectors all have the same disadvantage: when more than two events strike this type of detector simultaneously, the calculated position is the center of gravity of the positions of each impact.

Therefore, these detectors are sensitive to only one event at a time.

In fact, there are only two known detectors capable of precisely identifying multiple impacts in time and in space.

These two detectors have been developed for time of flight mass spectrometry systems, for example such as three-dimensional atom probes.

The first of these two detectors is described in documents (3) to (7).

The principle of this first detector is as follows.

An assembly of microchannel plates is placed in front of a square grid of 10×10 anodes which is laid out in a plane.

Therefore, it may be said that it is a checker board detector.

The cluster of electrical charges created by the arrival of an ionic impact irradiates a few anodes (an anode has an area of the order of 1 $cm^2$).

The time of flight of the impacts is measured by means of an electrical signal taken from the rear face of the microchannel plates.

This signal also triggers the simultaneous measurement of 96 charges collected on the anodes grid.

The charge collected on each anode is integrated by charge converters, the reading time of which is too long to enable fast reiteration of the measurement.

Several converters are used to record impacts separated by not more than 10 ns.

These converters are mounted in parallel, but they are triggered successively by the signal indicating the instant at which the impacts occur.

Therefore, this first known detector is capable of localizing simultaneous impacts, and impacts very close together in time.

The second known detector is mentioned in document (8).

Its principle is largely inspired from a known device described in document (9).

In this second known detector, microchannel plates are placed in front of a transparent screen on which a phosphorescent coating is deposited.

The arrival of an impact then creates a light spot that crosses the screen.

A semi-transparent mirror placed at 45° behind the screen divides this light spot into two parts.

The arrival of an impact also creates two light signals.

A first light signal is focused through a lens onto a CCD camera that records the position of the impacts.

The second light signal is focused on a photomultiplier that measures the time of flight of the impact.

This photomultiplier comprises 80 anodes and is therefore capable of recording up to 80 time of flight signals in parallel.

It is then easy to correlate the position of the impacts on this anodes grid with the positions recorded by the CCD camera.

This second known detector is capable of recording simultaneous impacts.

It can also localize impacts at very close time intervals, provided that their lines on the screen do not coincide with the same photomultiplier anode.

The first detector mentioned above is complex and expensive due to the electronic charge measurement and processing equipment associated with it.

The second detector mentioned above is complex and expensive due to its composition.

Furthermore, the large number of successive signal transformations in this detector causes a loss of sensitivity, and difficulty in focusing.

DISCLOSURE OF THE INVENTION

The purpose of this invention is to overcome the disadvantages mentioned above by proposing a spatial particle detector sensitive to the position of impacts that occurs simultaneously or at very close time intervals but which is simpler, more reliable and less expensive than the two known detectors mentioned above.

Specifically, the purpose of this invention is a particle detector characterized in that it comprises:

electron multiplication means that are capable of producing a cluster of electrons under the impact of each particle, a layer of a light emitting material that allows this cluster of electrons to pass through, and emits a light pulse by interaction with the electron cluster, and electron detection means capable of collecting this cluster of electrons and providing an electrical signal to determine the particle impact time, and which are sensitive to the position and capable of supplying information about the positions of impacts for each moment thus determined, these detection means also being transparent to light pulses so that the positions of impacts may be determined by localizing light pulses emitted by the layer of material, and correlating these positions with the moments determined by the electron detection means.

The detector may also comprise photodetection means capable of localizing light pulses emitted by the layer of material.

These photodetection means may comprise a Charge Coupled Device (CCD) camera, which is designed to receive light pulses after passing through the electron detection means.

The electron multiplication means preferably include several microchannel plates superposed on each other.

According to a first specific embodiment of the detector according to the invention, the electron detection means comprise a set of anodic conductors that are transparent to light pulses and are electrically insulated from each other.

The anodic conductors can form parallel strips or circular sectors or concentric rings.

According to a second specific embodiment of the detector according to the invention, the electron detection means are of the analog type.

In this case, these detection means may comprise a Wedge And Strip Anode which is transparent to light pulses or a Resistive Anode Encoder which is transparent to these light pulses.

BRIEF DESCRIPTION OF THE DRAWINGS

This invention will be better understood by reading the description of example embodiments given below, which is given solely for information and is in no way restrictive, with reference to the attached drawings, on which.

DETAILED DESCRIPTION OF SPECIFIC EMBODIMENTS

Figure 1:
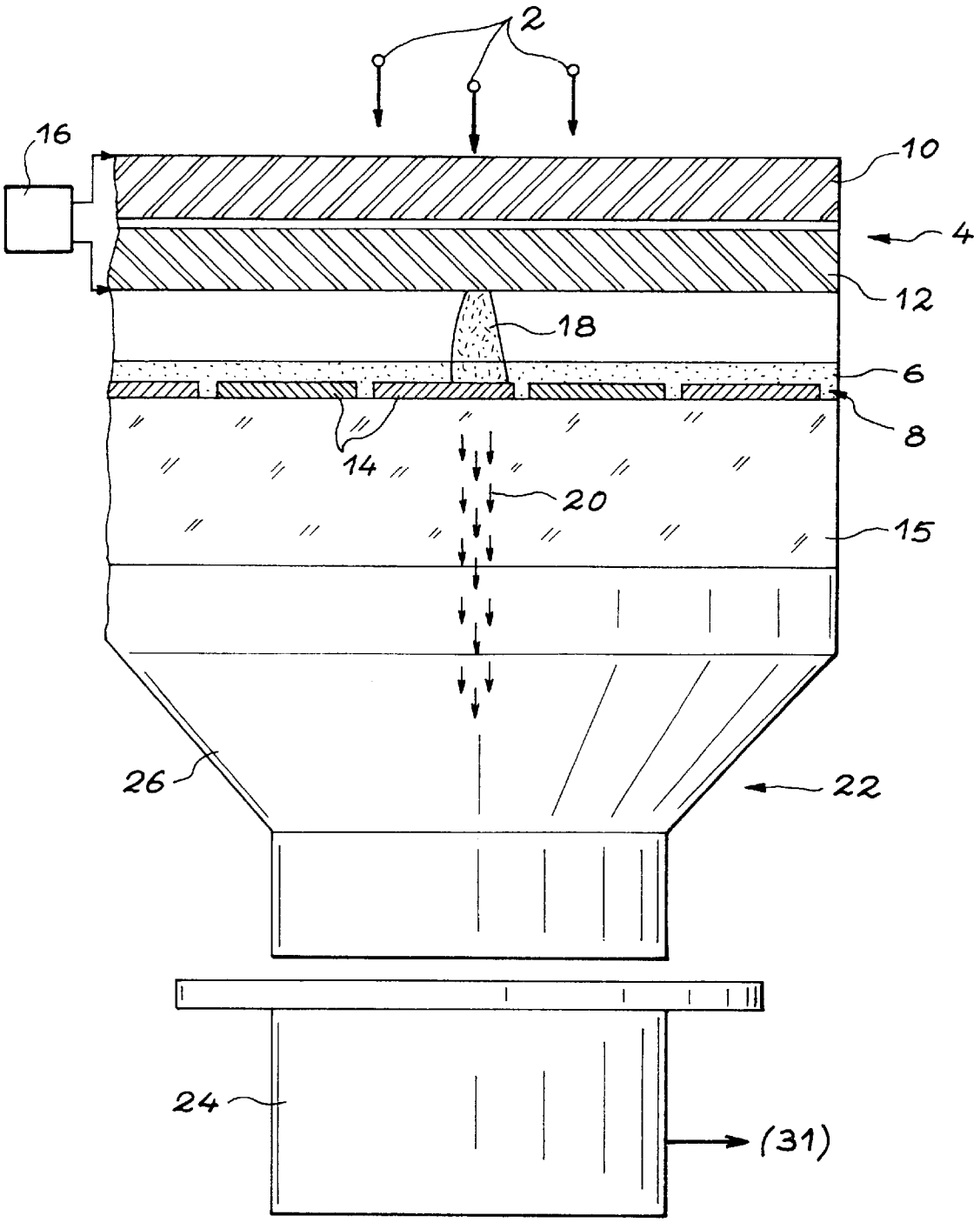
FIG. 1 is a schematic sectional view of a specific embodiment of the device according to the invention, in which the electron detection means comprise anodic conductors in the form of parallel strips.
Figure 2:
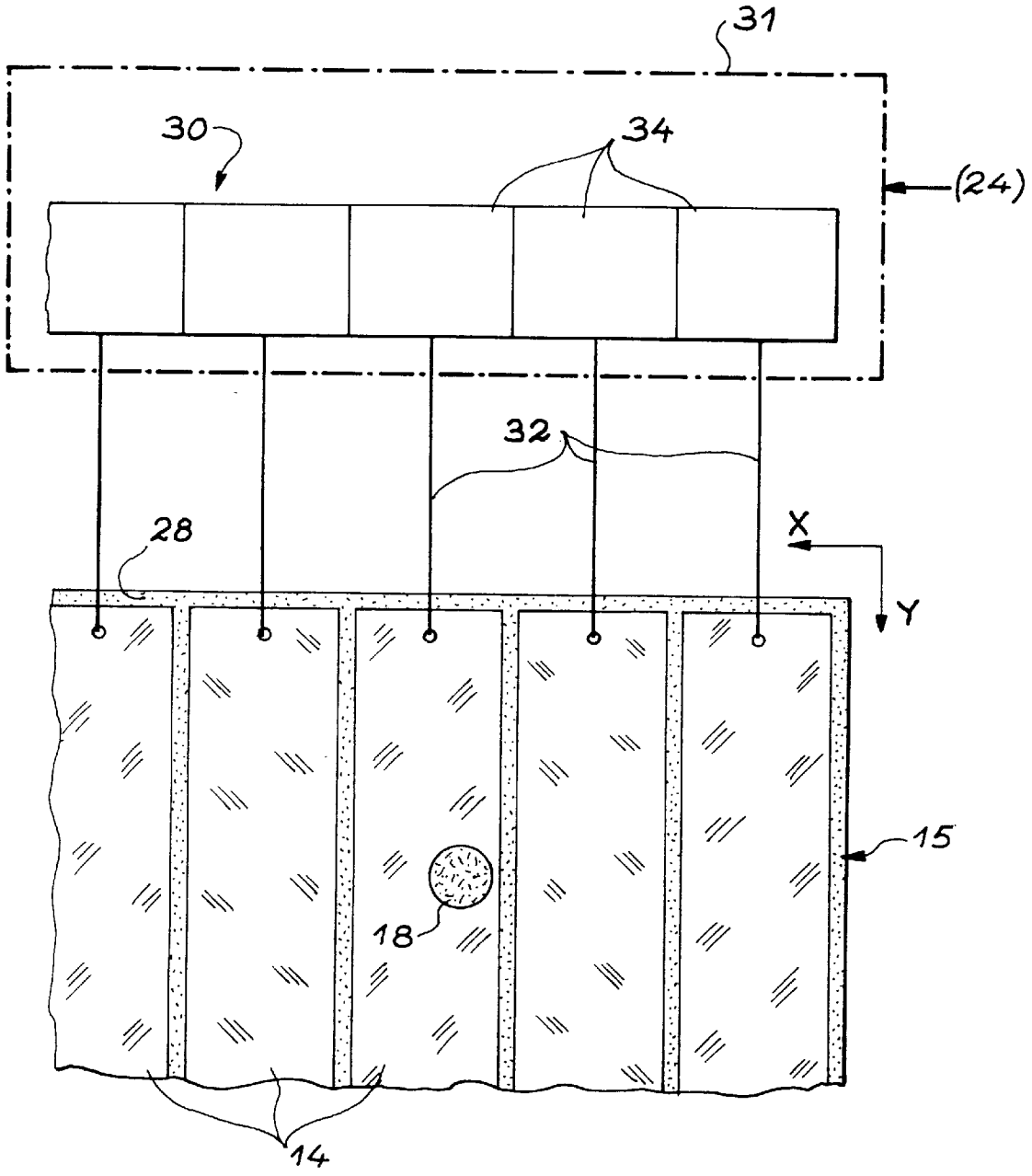
FIG. 2 is a schematic top view of these anodic conductors.

The detector according to the invention which is schematically shown in FIGS. 1 and 2, may for example be designed to detections 2.

For example, this detector in FIGS. 1 and 2 may be integrated into an atom probe.

In this case, the ions originate from a sample that is to be analyzed using this probe.

The device in FIGS. 1 and 2 comprises the following in sequence:

electron multiplication means 4, a layer of light emitting material 6, and electron detection means 8.

Electron multiplication means 4 comprise two microchannel plates 10 and 12 which are superposed.

As can be seen in FIG. 1, the microchannels in plate 10 form a herringbone pattern with the microchannels in plate 12.

In another detector conform with the invention, three superposed microchannel plates may be used, in which the microchannels form a Z pattern rather than a herringbone pattern.

The electron detection means 8 comprise a set of anodic conductors 14 which are transparent to light that may be emitted by the layer of light emitting material 6 and which are electrically isolated from each other.

More precisely, the anodic conductors 14, or the anodes, form strips parallel to the surface of a glass plate 15 which is transparent to the light that may be emitted by layer 6.

This layer 6 is a continuous phosphorescent deposit that covers anodes 14 and is located facing the microchannel plate 12, this plate being located below plate 10.

Appropriate polarization means 16 are provided to put the entry surface of the plate 10 at a continuous negative potential, for example equal to −5000 V, and the plate exit surface at a continuous negative potential greater than that of plate 10, and for example equal to −3000 V.

Layer 6 is referenced to the ground.

Each impact of an ion 2 on the set of microchannel plates creates an electron cluster which forms a very fine beam 18 containing about $10^7$ electrons.

This fineness of the electron cluster is the result of it being concentrated by the applied electric voltage at the exit from the plates.

Note that the distance between the microchannel plate 12 and the layer of phosphorescent material is very small, for example of the order of 1 to 2 mm.

The layer 6 may for example be made of $CaF_2$:Eu and it is sufficiently thin so that the electron beam, that was accelerated by a potential difference of a few kV (3 kV in the example described) can pass through it.

Thus this accelerated electron beam 18 passes through this layer 6 while exciting the layer, before passing through one of the anodes located under layer 6.

This layer 6 thus excited emits a light pulse 20 corresponding to the position of the impact of ion 2 on the microchannel plates.

The light pulse 20 passes through all transparent anodes 14 and then through the glass plate 15.

Thus each impact is displayed in the form of a very small light spot.

Note that the assembly comprising the plate 15, anodes 14, layer 6 and plates 10 and 12 is mounted on a sealing flange (not shown) since, when the detector is used, there is a vacuum above the microchannel plates (where the ions are moving) and between these plates and the phosphorescent layer.

The device in FIGS. 1 and 2 also comprises photodetection means 22 designed to localize light pulses emitted by layer 6.

These photodetection means comprise:

a CCD type camera 24, and an optical reducer 26 placed between the glass plate 15 and the entry surface into this camera 24 as can be seen in FIG. 1, so that light leaving the glass plate is directed to this entry surface.

To give an idea, but without in any way being restrictive, a set of about a hundred anodes is used in the form of strips, this assembly covers an area of the order of 10 cm×10 cm and each anode is a thin gold layer with a thickness of 30 to 50 nm, or a thin layer of platinum of the same thickness.

Note that the number of anodes depends on the application chosen for the detector.

This number of anodes must be sufficient to minimize the probability of having impacts on the same strip during the CCD camera active time.

The anodes grid 14 in the detector in FIGS. 1 and 2 performs three functions.

Firstly, this anodes grid collects and evacuates the electron beams that are output from the microchannel plates and which pass through the phosphorescent layer 6.

Secondly, this anodes grid supplies electrical signals for determination of particle impact moments.

Furthermore, this anodes grid forms an electron detector sensitive to the position.

This grid is composed of independent anodes such that the position of impacts along one of the two directions perpendicular to the plane of the anodes (this plane being surface 28 of the glass plate supporting these anodes) is known for each recorded moment.

In the example in FIG. 2, these two directions are referenced X and Y respectively, the anodes are parallel to direction Y and the position of the impacts is known along direction X.

Thirdly, the anodes grid is transparent to the light spot produced by layer 6 for each impact.

Camera 24 is capable of localizing light spots emitted by layer 6 and therefore determining the position of impacts since each light pulse is an extension of this impact.

Under these conditions, the detector in FIGS. 1 and 2 is capable of correlating each impact position with the measured moment on the corresponding anode which was irradiated by the electron beam associated with this impact.

Thus the detector in FIGS. 1 and 2 unambiguously associates an arrival time with each light spot produced by the arrival of a burst of ions that impact simultaneously, or at very short time intervals.

The space and time information is thus correlated with a separating power better than 0.5 mm in distance (and related to the number of pixels in the CCD camera), and equal to 1 ns in time (precision of the time counters).

The irradiated anode outputs a time of flight signal for each of the displayed light spots.

The spatial resolution is not given by the width of the anodes, but rather by the resolution of the camera used which digitizes the position of the light spot.

The number of anodes determines the capacity of the detector to associate one and one only time of flight with each of these light spots.

Operation is ideal when not more than one impact strikes each anode for each ion burst (1 to 10 impacts).

The transparent anodes grid, which is covered with a phosphorescent layer, together with the two microchannel plates, is capable of localizing ion impacts in space (using the corresponding light spots) and measuring the times associated with each of these impacts (due to the independent anodes).

When used with a conventional atom probe, this detector can be used for observation and quantitative analysis of a metallic material on the atomic scale.

The chemical nature of each of the atoms for which an image is obtained is identified by time of flight mass spectrometry.

The atom probe is thus transformed into a three-dimensional atom probe.

The detector in FIGS. 1 and 2 has the following advantages compared with known detectors described in documents (3) to (7).

The structure of the detector in FIGS. 1 and 2 is simpler, and it is easier to use: in this detector, the position of an impact is given by a light spot and the time of flight measurement is conventional.

It is more efficient and more reliable: all impacts are displayed and localized reliably and simply.

It is less expensive.

In particular, note the simplicity of the algorithms necessary to determine the positions of impacts using the detector in FIGS. 1 and 2.

The checker board detector, described in documents (3) to (7) is of the analog type since it is based on the measurement of electrical charges collected by a matrix grid of anodes.

It is then necessary to know the spatial distribution of the charge in the electron clusters output from the microchannel plates.

With the detector in FIGS. 1 and 2, the position coding is binary and considerably reduces calculation times.

Furthermore, with the detector in FIGS. 1 and 2, the failure rate in the localization of simultaneous events is less than what would be obtained with the detector described in documents (3) to (7).

In the latter detector, the position of an impact can be calculated at the expense of strong defocalization of electron clusters that have to irradiate at least four adjacent anodes.

The spatial extent of an impact on this detector increases the probability of two simultaneous events overlapping.

On the other hand, with the detector in FIGS. 1 and 2, the localization of impacts is easier because electron clusters are highly focused on the phosphorescent deposit.

This detector in FIGS. 1 and 2 can thus considerably lower the failure rate in the detection of simultaneous impacts.

The detector in FIGS. 1 and 2 is much simpler and is much more sensitive than the known detector described in documents (8) and (9).

It is capable of separating electrical and light signals resulting from impacts almost directly at the exit from microchannel plates.

After exciting the phosphorescent coating, electrons that pass through the anodes are used directly as a time of flight measurement signal.

Thus, it is no longer necessary (as was the case in the known detector described in documents (8) and (9)) to transform the electron cluster into a light spot and then once again into an electrical signal by means of a semi-transparent mirror followed by a photomutiplier.

The increased detection efficiency of the detector in FIGS. 1 and 2 is another advantage in addition to its simplicity.

Obviously, this detector is also less expensive.

We will now give some information about electrical signal processing in the detector in FIGS. 1 and 2.

Anodes 14 are connected to time measurement means 30 by electrical conductors 32 that are connected to the ends of these anodes 14.

An electrical signal created by the impact of an electron beam on an anode is thus directed towards these time measurement means 30.

These means include a set of fast time to digital converters 34 that are associated with anodes 14, and which determine the instant of arrival of an electron beam on the associated anode.

The camera 24 is triggered by the particle pulse, i.e. the moment at which these particles leave their source (not shown).

In the example of an atom probe, this start pulse is an electrical pulse that causes the departure of the ions from the sample to be analyzed, and which is used to trigger the opening of the CCD camera.

Electronic means 31 for processing signals output by electron detection means 8 and photodetection means 22, are provided to determine the moments and positions of particle impacts and correlate these positions with these moments. These means 31 contain time measurement means 30.

Note that these anodes are rectangular in the case shown in FIGS. 1 and 2, which means that the failure rate is independent of the position.

Furthermore, the use of anodes in strip form means that electrical signals can be transported from the initial impacts of electron beams as far as the ends of these strips without the need to use electrical connectors which would hinder observation of the layer of phosphorescent material.

Anodes 14 form a spatial electron detector with which the positions are coded discontinuously.

Figure 3:
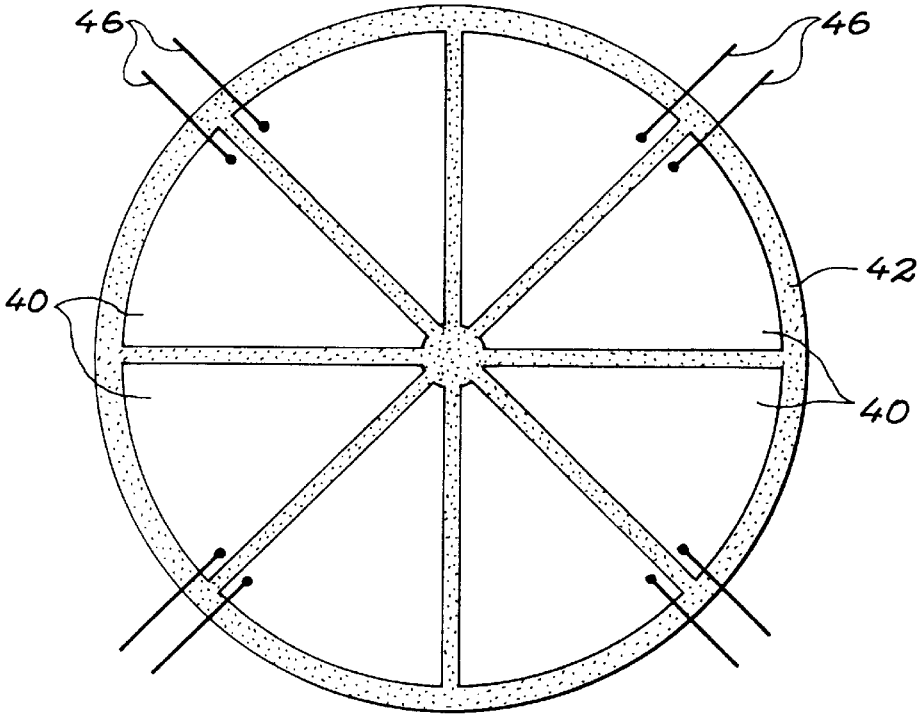
FIGS. 3 to 6 are schematic views of alternative embodiments of electron detection means.

FIG. 3 schematically illustrates the possibility of replacing the anodes 14 in the form of parallel strips by anodes that form circular sectors 40, and which are obviously also transparent to light originating from the layer of phosphorescent material (not shown) associated with these anodes.

FIG. 3 also shows a glass plate 42 on which these anodes 40 are formed and under which the CCD camera (not shown) is placed.

It also shows conductors 46 connected to the periphery of anodes 40 and terminating on these means (not shown) of processing signals output from these anodes 40.

Figure 4:
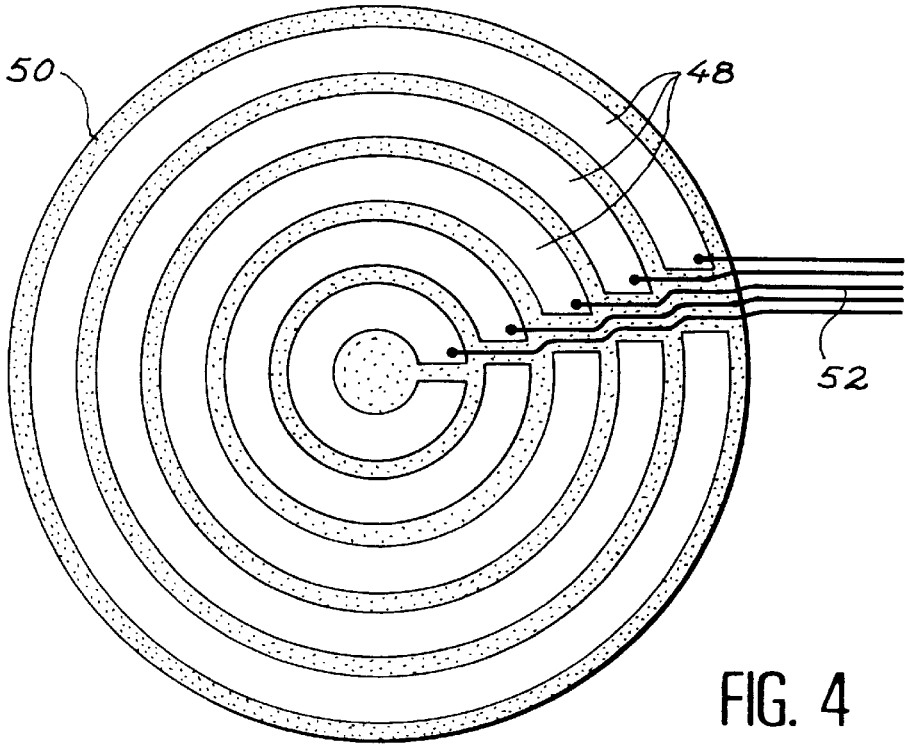

FIG. 4 illustrates another possibility of using anodes in the form of concentric rings 48 instead of anodes in the form of parallel strips, these concentric rings also being transparent to light originating from the associated layer of phosphorescent material (not shown) and which are also formed on a glass plate 50 below which the CCD camera (not shown) is placed.

These concentric rings are not closed on themselves, and electric connectors 52 can be seen connected to the ends of these rings and leading to means (not shown) of processing signals output by these rings.

In the case shown in FIGS. 3 and 4, the positions of the impacts are also coded discretely.

Instead of using a spatial electron detector in which positions are coded discretely, an electron detector may be used in which positions are coded continuously.

Figure 5:
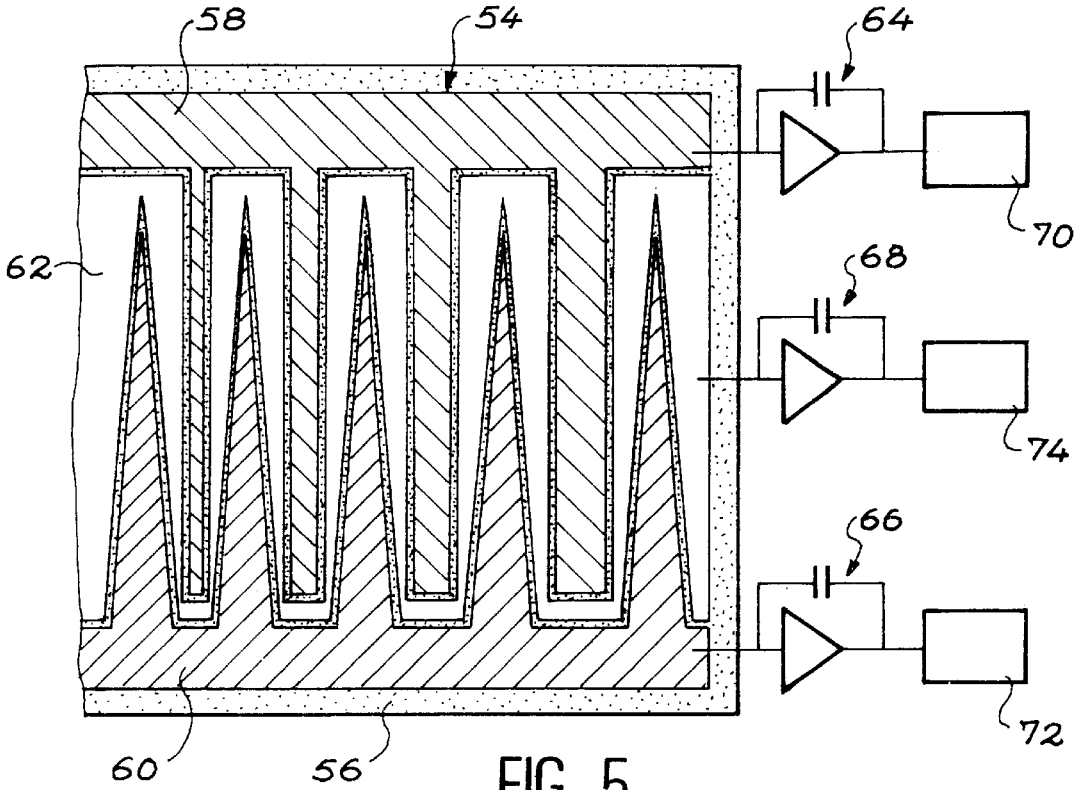
Figure 6:
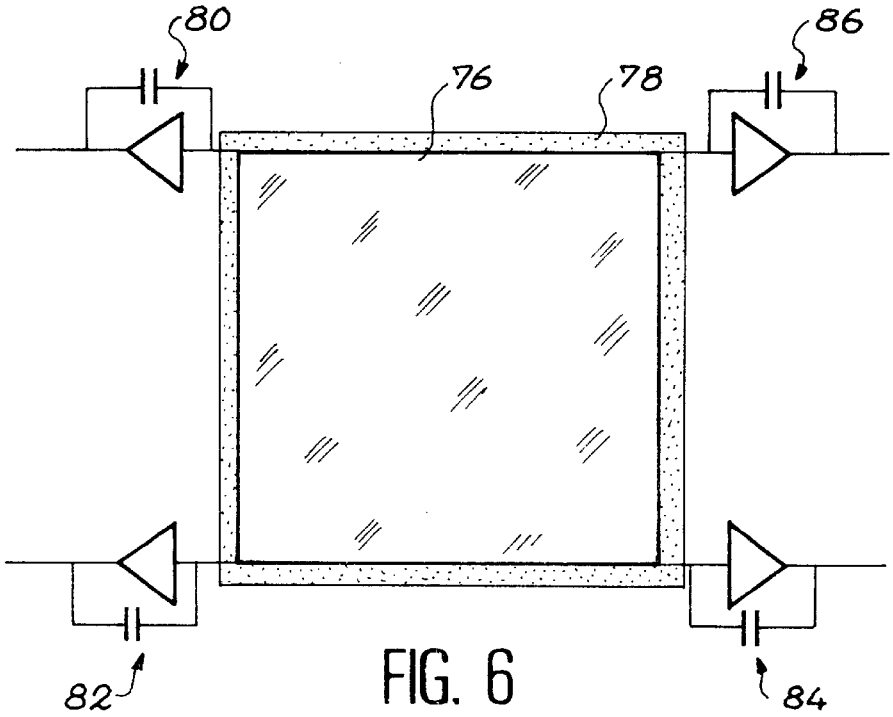

This is illustrated schematically in FIGS. 5 and 6.

FIG. 5 schematically illustrates the possibility of using a wedge and strip anode 54 which is transparent to light pulses output by this layer, as an electron detector placed below the layer of phosphorescent material.

For example, this anode 54 may be made using an appropriate thin deposit of gold on the glass plate 56, below which a CCD camera is placed for observation of light pulses.

This type of anode is well known in the state of the art and consists of a set of three electrodes referenced 58, 60 and 62 in FIG. 5.

The electrode 58 is a grid of conducting strips, the width of which increases linearly in one direction.

The electrode 60 is a grid of triangular electrodes, the area of which increases linearly in the direction perpendicular to the previous direction.

Electrode 62 "covers" the free area between electrodes 58 and 60, these electrodes 58, 60 and 62 obviously being electrically insulated from each other.

The arrival of an ion on the associated microchannel plates produces another electron beam that reaches anode 54.

The corresponding charge is then divided between the three electrodes 58, 60 and 62.

The charge collected on each anode is measured to calculate the center of gravity of the electron beam and to estimate the position of the corresponding impact on the microchannel plates.

The three charges are measured by charge preamplifiers 64, 66 and 68 followed by analog-digital converters 70, 72 and 74, synchronously with the arrival of the ion.

The time of flight signal at the exit from the microchannel plates triggers opening of the charge integration windows.

When an ion arrives, the position of the impact and the moment of impact can still be determined.

When two ions arrive at instants separated by the dead time of the electronic means associated with anode 54, it is possible to determine their impact position and their moment of impact.

When they arrive at instants separated by an interval less than this dead time, anode 54 can only detect one ion at a position equal to the center of gravity between the two corresponding impacts.

However, the CCD camera can determine the positions of the two ions.

FIG. 6 schematically illustrates the possibility of using a resistive anode 76 transparent to light pulses output from the associated layer of phosphorescent material (not shown) as an electron detector.

This anode 76 is also formed on a glass plate 78 below which a CCD camera (not shown) is placed for observation of light pulses output from this layer.

The resistive anode 76 provides the position of the electron beam corresponding to the impact of an ion on the associated microchannel plates and which arrives on anode 76.

The moment of impact information is provided by these plates.

The wedges of anode 76, which is square, are connected to the charge amplifiers 80, 82, 84 and 86 respectively.

The signals output by these amplifiers are processed in means not shown in order to obtain the impact position of an electron beam output from microchannel plates, after passing through the layer of phosphorescent material.

The invention is not limited to ion detection.

A detector of the type shown in FIGS. 1 and 2 can also detect the positions of electron impacts on microchannel plates and the moments of impacts of these electrons.

The impact positions and the impact moments of photons can also be detected by adding a plane photocathode (not shown) to the detector in FIGS. 1 and 2, placed above the microchannel plates and which supplies an electron beam for each photon that arrives on this photocathode.

This electron beam then arrives on the microchannel plates and the procedure is the same as above: the impact position and the impact moment of the photon on the photocathode can be detected.

The following documents are referenced in this description:

(1) M. K. Miller, *Surface Science,* 1992, 266, 494–499

(2) A. Carezo, T. J. Godfrey and G. D. W. Smith, *Rev. Sci. Instr.,* 1988, 59, 862–866

(3) D. Blavette, A. Bostel, J. M. Sarrau, B. Deconihout and A. Menand, "An Atom-Probe For Three Dimensional Tomography", *Nature* 363 (1993) 432–435

(4) D. Blavette, B. Deconihout, A. Bostel, J. M. Sarrau, M. Bouet and A. Menand, "The Tomographic Atom-Probe: A Quantitative 3D Nanoanalytical Instrument On An Atomic Scale", Rev. Sci. Instr. 64 (10) (1993) 2911–1919

(5) B. Deconihout, A. Bostel, P. Bas, S. Chambreland, L. Letellier, F. Danoix and D. Blavette, "Investigation Of Some Selected Metallurgical Problems With The Tomographic Atom-Probe", Appl. Surf. Sci. 76/77 (1994) *145–154*

(6) D. Blavette and A. Menand, "New Developments In Atom-Probe Techniques And Potential Applications To Material Science", Invited Article For MRS Bulletin, vol. 19, No. 7 (1994) 21–26

(7) B. Deconihout, A. Bostel, M. Bouet, J. M. Sarrau, P. Bas and D. Blavette, "Performance And Limitations Of The Multievent Position Sensitive Detector Used In The Tomographic Atom Probe", Appl. Surf. Sci. 87/88 (1995) 428–437

(8) A. Cerezo, T. S. Godfrey, J. M. Hyde, S. S. Sijbrandij and G. D. W. Smith, Appl. Surf. Sci. 76/77 (1994) 374

(9) T. Kinugawa and T. Arikawa, Rev. Sci. Instr. 63 (1992) 3599.

We claim:

1. Particle detector (2) comprising:

electron multiplication means (4) that are capable of producing a cluster of electrons under the impact of each particle, and a layer of a light emitting material (6) that is capable of emitting a light pulse by interaction with the electron cluster, characterized in that this layer also allows this cluster to pass through it and that the detector also comprises electron detection means (8) capable of collecting this cluster of electrons and providing an electrical signal to determine the particle impact moment, and which are sensitive to the position and capable of supplying information about the positions of impacts for each moment thus determined, these detection means also being transparent to light pulses so that the positions of impacts may be determined by localizing light pulses emitted by the layer of material, and these positions may be correlated with the moments determined by means of the electron detection means.

2. Detector according to claim 1, characterized in that it also comprises photodetection means (22) that are capable of localizing light pulses emitted by the layer of material.

3. Detector according to claim 2, characterized in that these photodetection means comprise a charge coupled device camera (24), which is designed to receive light pulses after passing through the electron detection means.

4. Detector according to claim 1, characterized in that the electron multiplication means comprise several microchannel plates (10, 12) superposed on each other.

5. Detector according to claim 1, characterized in that the electron detection means comprise a set of anodic conductors (14, 40, 48) that are transparent to light pulses and are electrically isolated from each other.

6. Detector according to claim 5, characterized in that the anodic conductors form parallel strips (14).

7. Detector according to claim 5, characterized in that the anodic conductors form circular sectors (40).

8. Detector according to claim 5, characterized in that the anodic conductors form concentric rings (48).

9. Detector according to claim 1, characterized in that the electron detection means are of the analog type.

10. Detector according to claim 1, characterized in that the electron detection means comprise a wedge and strip anode (54) that is transparent to light pulses, or a resistive anode encoder (76) that is transparent to these light pulses.

* * * * *